US007477007B2

(12) United States Patent
Suzuki et al.

(10) Patent No.: US 7,477,007 B2
(45) Date of Patent: Jan. 13, 2009

(54) SPARK PLUG WITH NOBLE METAL-TIP STRUCTURE

(75) Inventors: Akira Suzuki, Aichi (JP); Tomoaki Kato, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 490 days.

(21) Appl. No.: 11/236,589

(22) Filed: Sep. 28, 2005

(65) Prior Publication Data

US 2006/0066195 A1 Mar. 30, 2006

(30) Foreign Application Priority Data

Sep. 29, 2004 (JP) ..... 2004-285214

(51) Int. Cl.
*H01T 13/20* (2006.01)

(52) U.S. Cl. ..... 313/141; 313/118; 313/143

(58) Field of Classification Search ..... 313/118, 313/141–143

See application file for complete search history.

(56) References Cited

U.S. PATENT DOCUMENTS

2002/0105254 A1* 8/2002 Hori et al. ..... 313/141
2003/0038577 A1* 2/2003 Hori et al. ..... 313/141
2004/0041506 A1* 3/2004 Teramura et al. ..... 313/141
2005/0023949 A1* 2/2005 Hori ..... 313/141

* cited by examiner

*Primary Examiner*—Toan Ton
*Assistant Examiner*—Kevin Quarterman
(74) *Attorney, Agent, or Firm*—Sughrue Mion, PLLC

(57) ABSTRACT

A spark plug configured such that a noble-metal tip is welded to each of a front end portion of a center electrode and a distal end portion of a ground electrode. The noble-metal tip of the center electrode or the ground electrode, whichever has a weld metal zone having a greater projected area where an electrode base metal and a metal of the noble metal tip are fused together, is made greater in exposed length of the noble-metal tip. In a preferred embodiment, the projected area of the weld metal zone and the exposed length of the noble-metal tip on the ground electrode side are made greater than those on the center electrode side.

6 Claims, 5 Drawing Sheets

SPARK PLUG WITH NOBLE METAL-TIP STRUCTURE

BACKGROUND OF THE INVENTION

1. Field of the Invention

The present invention relates to a spark plug having a noble-metal tip that is welded to each of a front end portion of a center electrode and a distal end portion of a ground electrode so as to form a spark discharge gap between the noble-metal tips.

2. Description of the Related Art

A spark plug is attached to an engine of an automobile or the like and used as an igniter for igniting an air-fuel mixture so as to drive the automobile or the like. Such a spark plug is generally configured as follows: an insulator holding a center electrode is fixedly fitted into a metallic shell having an externally threaded portion used to mount the spark plug to an engine; and a ground electrode is joined to a front end portion of the metallic shell such that a spark discharge gap is formed between opposed end portions of the center and ground electrodes.

The combustion performance of an engine greatly depends on the ignition performance of a spark plug. In order to maintain its ignition performance over a long period of time, a certain spark plug is configured such that a noble-metal tip formed of an iridium (Ir) alloy, a platinum (Pt) alloy, or the like, which exhibits excellent resistance to spark-induced consumption and oxidation-induced consumption, is welded to each of a front end portion of a center electrode and a distal end portion of a ground electrode.

For example, Patent Document 1 discloses a spark plug in which a tip formed of an iridium alloy is welded to each of a front end portion of a center electrode and a distal end portion of a ground electrode, whereby the spark plug exhibits excellent resistance to consumption.

[Patent Document 1] Japanese Patent Application Laid-Open (kokai) No. 2002-184551 (FIGS. 20, 25, and 26)

3. Problems to be Solved by the Invention

Although a spark plug may have noble-metal tips which exhibit excellent resistance to consumption, this does not necessarily mean that the spark plug itself exhibits excellent resistance to consumption and extended service life. Conceivably, such a spark plug fails to exhibit extended service life for the following reason. Spark discharges do not always occur at expected positions, and as a result, the noble-metal tip may become detached from a center electrode or a ground electrode (hereinafter also called a base metal). The present inventors have determined that spark discharges which concentrate on a weld metal zone where the noble-metal tip and the base metal are joined together can result in detachment of a noble metal tip, thereby causing unusual consumption of the weld metal zone.

SUMMARY OF THE INVENTION

The present invention has been accomplished in view of the above problems of the prior art, and therefore an object of the present invention is to provide a spark plug which restrains unusual consumption of a weld metal zone where a noble-metal tip and a base metal are joined together so as to avoid detachment of the noble-metal tip or a like problem.

The above object of the present invention has been achieved by providing (1) a spark plug which comprises a center electrode having a columnar shape; an insulator accommodating a rear end portion of the center electrode; a metallic shell accommodating the insulator; a ground electrode whose first end is connected to a front end portion of the metallic shell; a first noble-metal tip joined, via a first weld metal zone, to one of an axially front end portion of the center electrode and a second end portion of the ground electrode; and a second noble-metal tip joined, via a second weld metal zone, to the other of the front end portion of the center electrode and the second end portion of the ground electrode, and forming a spark discharge gap between the first and second noble-metal tips. In the spark plug, a projected area $S_L$ of the first weld metal zone, obtained by measuring an area of the first weld metal zone projected onto an imaginary plane perpendicular to an axial direction of the first noble-metal tip, is greater than a projected area $S_S$ of the second weld metal zone, obtained by measuring an area of the second weld metal zone projected onto an imaginary plane perpendicular to an axial direction of the second noble-metal tip. Furthermore, an exposed length $L_L$ of the first metal tip as measured from the first weld metal zone is greater than an exposed length $L_S$ of the second noble-metal tip as measured from the second weld metal zone.

In a preferred embodiment (2), the spark plug is characterized in that the first noble-metal tip is joined to the second end portion of the ground electrode.

In yet another preferred embodiment (3), the spark plug is characterized in that the first and second weld metal zones are formed by laser welding.

In yet another preferred embodiment (4), the spark plug is characterized in that the front end portion of the center electrode is tapered such that its diameter decreases toward the axial front end of the center electrode.

In yet another preferred embodiment (5), the spark plug is characterized in that the second noble-metal tip has a diameter of 0.4 mm to 0.7 mm, and the projected area $S_S$ of the weld metal zone of the second noble-metal tip is 0.12 $mm^2$ to 0.65 $mm^2$; and the first noble-metal tip has a diameter of 0.4 mm to 0.91 mm, and the projected area $S_L$ of the weld metal zone of the first noble-metal tip is 0.44 $mm^2$ to 2.85 $mm^2$.

In the spark plug of the present invention, a noble-metal tip is welded to each of the front end of the center electrode and the distal end of the ground electrode. Each of the two noble-metal tips is joined to the base metal of the center electrode or the ground electrode via a weld metal zone where the base metal and the noble metal are fused together. The base metal, the weld metal zone, and the exposed noble-metal tip are arranged in this order. When the weld metal zone of the noble-metal tip of the center electrode and that of the ground electrode are projected onto corresponding imaginary planes perpendicular to the respective axes of the noble-metal tips, and each of their projected images has an area (hereinafter called a projected area) of $S_L$ or a projected area $S_S$ ($S_L$ is greater than $S_S$), the exposed noble-metal tip associated with the projected area $S_L$ has a length (hereinafter called an exposed length) of $L_L$, which is greater than an exposed length $L_S$ of the noble-metal tip associated with the projected area $S_S$. In other words, the projected area of the weld metal zone of the center electrode or the ground electrode, whichever is greater, is called the projected area $S_L$ associated with the first noble-metal tip, and the smaller projected area is called the projected area $S_S$ associated with the second noble-metal tip. By employing such a configuration, the frequency of occurrence of spark discharge on the weld metal zones can be suppressed.

According to embodiment (2), a noble-metal tip associated with a weld metal zone having a greater projected area, and having a greater exposed length; i.e., the first noble-metal tip, is provided on the ground electrode. This is particularly effective for the purpose of suppressing spark discharge on the weld metal zones.

The reason for effectiveness of the above arrangement will next be described.

As shown in FIG 1(*a*), noble-metal tips 33 and 43 are welded to a front end portion of a center electrode 3 and a distal end portion of a ground electrode 4, respectively. The noble-metal tips 33 and 43 welded to the base metals of the center and ground electrodes 3 and 4, respectively, serve as spark discharge electrodes and form a spark discharge gap G therebetween. When the noble-metal tips 33 and 43 are viewed in a direction perpendicular to an axis O thereof, the exposed noble-metal tip 33 (43), a weld metal zone 34 (44) where the base metal and a metal of the noble-metal tip 33 (43) are fused together in the course of welding, and the base metal are arranged adjacently, in this order. Each of the exposed noble-metal tips 33 and 43 has an exposed length L. In FIG. 1(*a*), the exposed noble-metal tip 43 of the ground electrode 4 has a longer exposed length of $L_L$, and the exposed noble-metal tip 33 of the center electrode 3 has a shorter exposed length of $L_S$. In FIG. 1(*a*), the noble-metal tips 33 and 43 are coaxial, sharing a common axis O.

When the center electrode 3 is viewed from the noble-metal tip 43 (in the direction A of FIG. 1), and the ground electrode 4 is viewed from the noble-metal tip 33 (in the direction B of FIG. 1(*a*)), each of the weld metal zones 34 and 44 assumes a substantially annular shape (FIG. 1(*b*)). The "projected area of a weld metal zone obtained by measuring the area of the weld metal zone projected onto an imaginary plane perpendicular to the axial direction of the corresponding noble-metal tip" means the area of the weld metal zone 34 as viewed in the direction A or the area of the weld metal zone 44 as viewed in the direction B. The projected area of a weld metal zone is represented by S. As in the case of the exposed length L, the weld metal zone 44 of the ground electrode 4 has a larger projected area of $S_L$, and the weld metal zone 34 of the center electrode 3 has a smaller projected area of $S_S$.

Premised on the above, the spark discharge gap regions of FIGS. 2(*a*) and 2(*b*) are compared. FIG. 2(*a*) shows the spark discharge gap region of the present invention and is compared with that of a Comparative Example of FIG. 2(*b*). The center electrodes 3 shown in FIGS. 2(*a*) and 2(*b*) assume the same shape, and each has a projected area of the weld metal zone 34 of $S_S$ and an exposed length of the noble-metal tip 33 of $L_S$. The ground electrode 4 shown in FIG. 2(*a*) has a projected area of the weld metal zone 44 of $S_L$, which is greater than the projected area $S_S$ of the weld metal zone 34 of the center electrode 3, and has an exposed length of the noble-metal tip 43 of $L_L$, which is greater than the exposed length $L_S$ of the noble-metal tip 33 of the center electrode 3. In FIG. 2(*b*), a noble-metal tip 43' is joined to a ground-electrode base metal of a ground electrode 4' via a weld metal zone 44' having a shape identical with that of the weld metal zone 34 of the center electrode 3. In other words, the weld metal zone 44' has a projected area $S_S$, and the noble-metal tip 43' exposed from the weld metal zone 44' has an exposed length $L_S$. FIGS. 2(*a*) and 2(*b*) have the same spark discharge gap G.

A spark discharge is generally known to occur across a small gap; i.e., where the electric field intensity is high. However, the present inventors have empirically confirmed that not all spark discharges necessarily occur across such a small gap, and have confirmed that a certain spark discharge preferentially occurs on a weld metal zone where a metal of a noble-metal tip and an electrode base metal are fused together. The mechanism of this phenomenon is not definitely understood. Conceivably, since the weld metal zone is a mixture of a noble metal and a base metal, which predominantly contains Ni, the weld metal zone has a lower work function as compared with the noble metal, so that the weld metal zone is susceptible to spark discharge.

In consideration of the above-mentioned phenomenon, even when the spark plugs of FIGS. 2(*a*) and 2(*b*) generate spark discharges under the same conditions (i.e., with the same voltage applied across their spark discharge gaps, with the same spark discharge gap, in the same atmosphere, and the like), the weld metal zone 44' of the spark plug of FIG. 2(*b*) experiences a higher frequency of occurrence of spark discharge as compared with the weld metal zone 44 of the spark plug of FIG. 2(*a*). This is because an end portion of the weld metal zone 44' is located closer to an opposed electrode (center electrode 3) than an end portion of the weld metal zone 44. As a result, the speed of consumption of the weld metal zone 44' increases. This tendency grows as the exposed length is reduced. In contrast to the spark plug of FIG. 2(*b*) in which the noble-metal tip 43' of the ground electrode 4 has an exposed length ($L_S$) identical with that ($L_S$) of the noble-metal tip 33 of the center electrode 3, the spark plug of FIG. 2(*a*) is configured such that an end portion of the weld metal zone 44 is located more distant from an opposed electrode (center electrode 3). Thus, the weld metal zone 44 experiences a reduced frequency of occurrence of a spark discharge. As a result, the spark-induced consumption of the weld metal zone 44 can be suppressed, while the projected area $S_L$ of the weld metal zone 44 can be set larger than the projected area $S_s$ of the weld metal zone 34. Accordingly, a spark plug in which detachment of a noble-metal tip or a like problem is suppressed can be implemented.

Next, a spark plug according to the preferred embodiment (2) above will be described.

As mentioned previously, in a ground electrode of a spark plug, an electric field is concentrated mostly on an end portion of a noble-metal tip of the ground electrode. Thus, a spark discharge occurs at the end portion of the noble metal tip, which exhibits excellent resistance to spark-induced consumption, whereby the service life of the spark plug is extended. Meanwhile, the shape of the ground electrode develops a tendency for an electric field to also concentrate on an edge portion (indicated by E in FIG 1(*a*)) of the ground electrode. Accordingly, while spark discharges generated at a front end portion of the center electrode are directed toward an end portion of the noble-metal tip 43 of the ground electrode 4 because of a short distance across a discharge gap, the concentration of an electric field on the edge portion E tends to direct a portion of the spark discharges toward the edge portion E. However, the distance between the front end portion of the center electrode and the edge portion E of the ground electrode 4 is not sufficiently short to continuously generate spark discharges therebetween. As a result, the spark discharges are unlikely to continue at the edge portion E. Further, as mentioned previously, the weld metal zone 44, which has a lower work function than the noble-metal tip 43 and thus more prone to occurrence of a spark discharge, is located closer to the front end portion of the center electrode than is the edge portion E of the ground electrode 4. Thus, a spark discharge occurs on the weld metal zone 44 instead.

In order to avoid the above problem, a weld metal zone that allows for a long exposed length ($L_L$) and has a large projected area ($S_L$) is provided on a ground electrode. This increases the distance between an end portion of the weld metal zone 44 and an opposed electrode (center electrode 3), thereby reducing the occurrence of spark discharges which could otherwise frequently occur on the weld metal zone of the ground electrode. Thus, detachment of a noble-metal tip or a like problem can be prevented, whereby the service life of a spark plug can be extended. Such a spark plug can be implemented by employing laser welding for joining a noble-metal tip and a base metal together. A weld metal zone formed by laser welding assumes a substantially trapezoidal shape, thereby enhancing the above-mentioned effect.

The center electrode 3 can also be examined for the above-mentioned phenomenon. The edge portion E of the base metal of the ground electrode 4 where an electric field concentrates corresponds to an edge portion E' of the center electrode 3 shown in FIG 1(*a*). A comparison of the angle between the edge portions E and E' indicates that the edge portion E' of the center electrode 3 is less prone to concentration of an electric field than the edge portion E of the ground electrode 4. Accordingly, as mentioned previously, when the projected area of the weld metal zone 44 of the ground electrode 4 is large, increasing the exposed length of the noble-metal tip 43 of the ground electrode 4 is effective in suppressing spark discharge on the weld metal. This is because of concentration of an electric field on an edge portion. In other words, increasing the projected area of a weld metal zone and the exposed length of a noble-metal tip of an electrode whose edge portion is smaller in angle than that of the other electrode, and also tapering the center electrode such that its diameter decreases toward a front end thereof, are effective in suppressing spark discharge on the weld metal.

DESCRIPTION OF REFERENCE NUMERALS

Figure 1A:
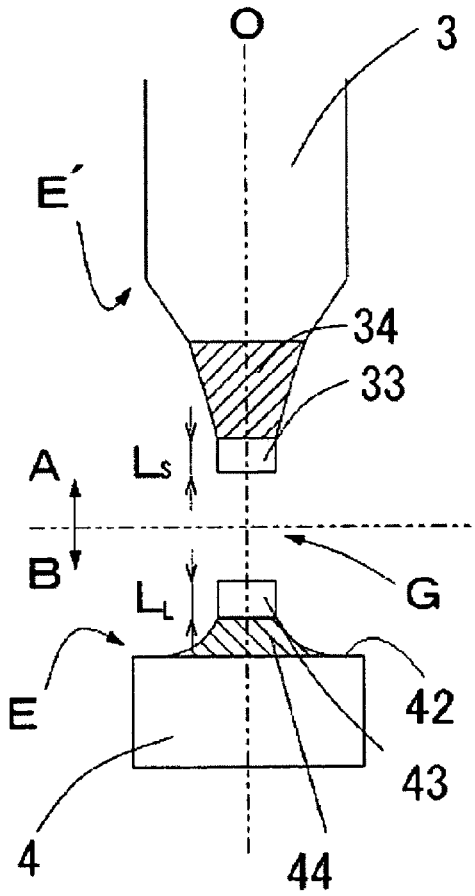
FIGS. 1(*a*) and (*b*) are enlarged views of a front end portion of a spark plug 100.

Reference numerals used to identify various structural features in the drawings include the following.

1: insulator
2: metallic shell
3: center electrode
4: ground electrode
5: terminal electrode
33: noble-metal tip (of center electrode)
34: weld metal zone (of center electrode)
43: noble-metal tip (of ground electrode)
44: weld metal zone (of ground electrode)
100: spark plug

DESCRIPTION OF THE PREFERRED EMBODIMENTS

An embodiment of the present invention will next be described with reference to FIGS. 3 to 5. However, the present invention should not be construed as being limited thereto.

Figure 3:
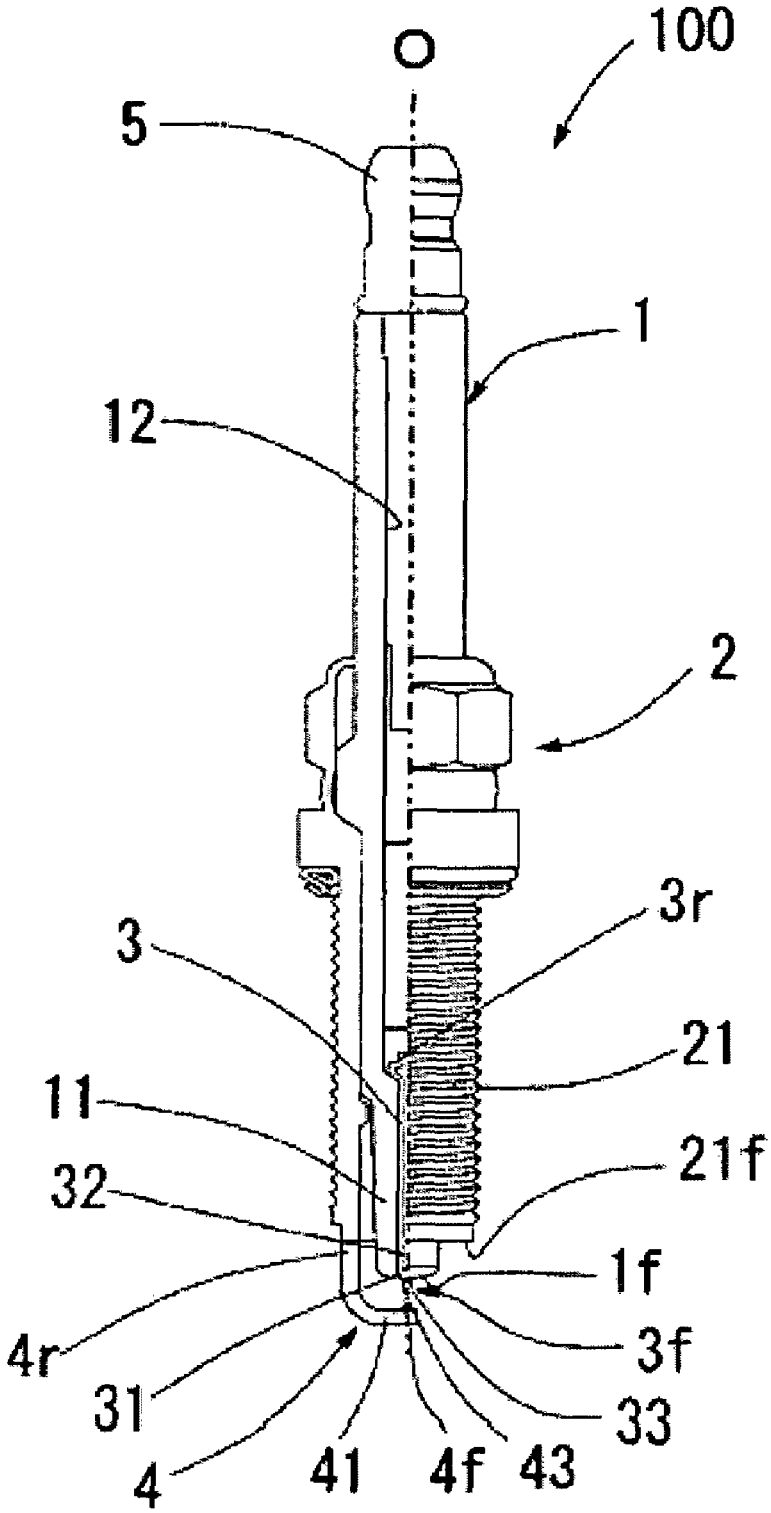
FIG. 3 is a partial sectional view of the spark plug 100.
Figure 4A:
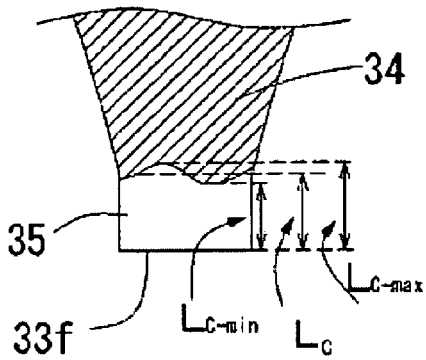
FIGS. 4(*a*) to 4(*d*) are views showing the exposed lengths of noble-metal tips 33 and 43 and regions used to measure a projected area.
Figure 4B:
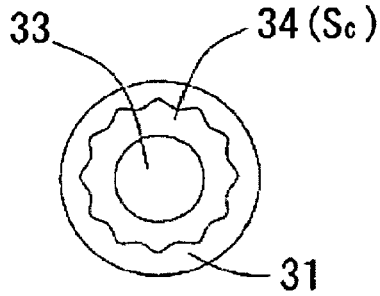
Figure 4C:
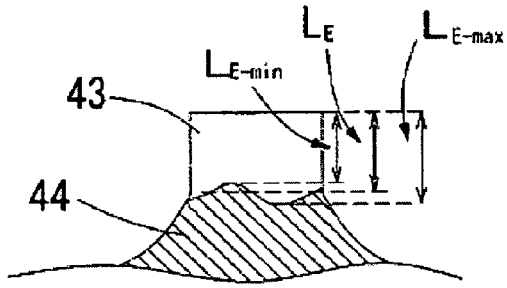
Figure 4D:
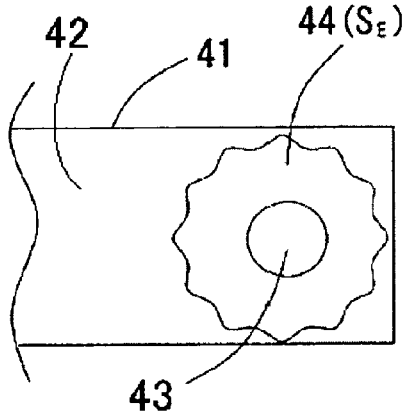

As shown in the general view of FIG. 3, a spark plug 100 according to the present embodiment includes an insulator 1 formed of alumina ceramic, and a tubular metallic shell 2 having an externally threaded portion 21 used to attach the spark plug 100 to an engine head (not shown) or the like. The metallic shell 2 surrounds the insulator 1 such that an end of a leg portion 11 of the insulator 1 projects from an end 21*f* of the externally threaded portion 21. A terminal electrode 5 is provided at a rear end portion of the insulator. Power is externally supplied to the terminal electrode 5.

The insulator 1 has a substantially tubular shape. An axial hole 12 is formed in the insulator 1 along the axis O. A front end portion 3*f* of a center electrode 3 projects from a front end face If of the insulator 1, and a rear end portion 3*r* of the insulator 1 is fixedly held within the axial hole 12 of the insulator 1. A base metal 31 of the center electrode 3 is a Ni-based heat-resistant alloy, such as Inconel 600™. Further, a high-heat-conduction metal 32, such as a copper alloy, is embedded in the center-electrode base metal 31. The high-heat-conduction metal 32 efficiently conducts heat from the front end portion 3*f* toward the rear end portion 3*r* so as to release heat to the engine head via the insulator 1, the metallic shell 2, and the like, thereby cooling the front end portion 3*f* of the center electrode 3. A noble-metal tip 33 of, for example, a Pt—Ir alloy is welded to the front end portion 3*f* of the center electrode 3. A contact portion between the noble-metal tip 33 and the center electrode metal 31 is circumferentially irradiated with a laser beam or electron beam to thereby form a weld metal zone 34 where the center-electrode base metal 31 and the metal of the noble-metal tip 33 are fused together, whereby the noble-metal tip 33 is fixed.

In the metallic shell 2, a columnar ground electrode 4 having a substantially rectangular cross section is joined to the end face of the externally threaded portion 21. A proximal end 4*r* of the ground electrode 4 is welded to the front end face of the metallic shell 2. A distal end 4*f* of the ground electrode 4 is bent toward the center electrode 3, in a shape resembling the letter L. The ground electrode 4 has a ground-electrode base metal 41, which is a Ni-based heat-resistant alloy, such as Inconel 600. As in the case of the center electrode 3, a high-heat-conduction metal, such as copper, may be embedded in the ground-electrode base metal 41 (not shown). The distal end 4*f* of the ground electrode 4 is bent such that a side surface 42 thereof faces the noble-metal tip 33 welded to the front end portion 3*f* of the center electrode 3. A noble-metal tip 43 is welded to the side surface 42 coaxially with the noble-metal tip 33 of the center electrode 3. The noble-metal tip 43 is formed of, for example, a Pt—Ni alloy. As in the case of the center electrode 3, a contact portion between the noble-metal tip 43 and the side surface 42 of the ground electrode 4 is circumferentially irradiated with a laser beam or electron beam to thereby form a weld metal zone 44 where the ground-electrode base metal 41 and the metal of the noble-metal tip 43 are fused together, whereby the noble-metal tip 43 is fixed.

The center electrode 3 and the ground electrode 4 are positioned such that the noble-metal tips 33 and 43 welded thereto form a spark discharge gap G therebetween.

Next, the joining condition will be described in detail with respect to the noble-metal tips 33 and 43 joined to the respective electrodes (the center electrode 3 and the ground electrode 4).

FIG. 4(*a*) shows, on an enlarged scale, a side view of the front end portion 3*f* of the center electrode 3. The center electrode 3 is tapered such that its diameter decreases toward a front end thereof. Further, the weld metal zone 34 is formed in the course of welding at a front end portion of the center electrode 3 also in a tapered manner such that its diameter decreases toward a front end thereof. The noble-metal tip 33 is joined to the center-electrode base metal 31 via the weld metal zone 34. As shown in FIG. 4(*a*), the noble metal tip 33 has an exposed portion 35, which projects from the weld metal zone. In some cases, a welding mark (e.g., laser welding mark) causes the boundary between the weld metal zone 34 and the exposed portion 35 to become nonlinear. $L_{C\text{-}min}$ represents a minimum distance as measured between the weld metal zone 34 and an end face 33*f* of the noble-metal tip 33 along the axial direction of the noble-metal tip 33. Similarly, $L_{C\text{-}max}$ represents a maximum distance between the weld metal zone 34 and the end face 33*f*. A value obtained by dividing the sum of the minimum distance $L_{C\text{-}min}$ and the maximum distance $L_{C\text{-}max}$ by 2 corresponds to the length of the exposed portion 35; i.e., an exposed length $L_C$. The exposed length $L_C$ of the exposed portion 35 is thus determined.

FIG. 4(*b*) shows the front end portion 3*f* of the center electrode 3 as viewed from its end face along the axis O. As shown in FIG. 4(*b*), the area of the weld metal zone 34 represented by a two-dimensional image viewed along the axis O is the projected area as used herein. In measuring the area, a two-dimensional image is taken with, for example, a digital camera, and the image thus obtained is digitized by use of commercially available image-processing software or the like. In this manner, a projected area $S_C$ of the weld metal zone 34 can be readily measured.

FIGS. 4(*c*) and 4(*d*) show the noble-metal tip 43 of the ground electrode 4. The exposed length of the noble-metal tip 43 can be obtained by replacing $L_{C\text{-}min}$ and $L_{C\text{-}max}$ appearing in the above description of the center electrode 3 with $L_{E\text{-}min}$ and $L_{E\text{-}max}$, respectively, appearing in FIG. 4(*c*), which is an explanatory view of the ground electrode 4. Also, a method for obtaining the projected area $S_E$ of the weld metal zone 44 of the ground electrode 4 can be obtained similar to that for obtaining the projected area $S_C$ of the weld metal zone of the center electrode 3. Thus, a description thereof is omitted. In this manner, the projected length $L_E$ of the noble-metal tip 43 and the projected area $S_E$ of the weld metal zone of the ground electrode 4 are determined.

The noble-metal tips 33 and 43 may be formed by a known method. For example, material powders including a noble-metal powder are mixed in predetermined weight ratios. The resulting mixture is melted to obtain an alloy ingot. The mixture can be melted by arc melting, plasma beam melting, high-frequency induction melting, or the like. In order to reduce segregation in an alloy composition, a molten alloy may be cast into a water-cooled casting mold to form a rapidly cooled ingot. Alternatively, a mixture of material powders including a noble-metal powder may be compacted and then sintered. Subsequently, the alloy ingot is subjected to hot forging, hot rolling, hot wire-drawing, and the like to thereby be formed into a wire, followed by cutting. The present embodiment uses the thus-formed noble-metal tip parts having a diameter of 0.55 mm. The noble-metal tip part for the noble metal tip 33 has a length of 0.6 mm before welding, while the noble-metal tip part for the noble-metal tip 43 has a length of 0.8 mm, i.e., a longer length than that of the noble-metal tip part for the noble metal tip 33. The present inventors confirmed that, when the noble-metal tip of the ground electrode has a diameter of 1.3Φ or less, where Φ is the diameter of the noble-metal tip of the center electrode, spark discharges directed to the weld metal zone of the ground electrode are suppressed very effectively. Specific preferred conditions are as follows: when the noble-metal tip of the center electrode has a diameter of 0.4 mm to 0.7 mm, the weld metal zone of the center electrode has a projected area of 0.12 $mm^2$ to 0.65 $mm^2$; and when the noble-metal tip of the ground electrode has a diameter of 0.4 mm to 0.91 mm, the weld metal zone of the ground electrode has a projected area of 0.44 $mm^2$ to 2.85 $mm^2$. At this time, when the noble-metal tip of the center electrode has an exposed length of 0.4 mm to 0.8 mm, the noble-metal tip of the ground electrode preferably has an exposed length of 0.5 mm to 1.0 mm. More preferably, in addition to conforming to the above-mentioned ranges of the exposed length, the exposed length of the noble-metal tip of the ground electrode is made greater than that of the noble-metal tip of the center electrode. The reason therefor will be described below.

In the thus-configured spark plug, a comparison can be made between a discharge electrode of the center electrode composed of a weld metal zone and an exposed portion, and a discharge electrode of the ground electrode composed of a weld metal zone and an exposed portion. This comparison shows that in the discharge electrode having a weld metal zone projected area greater than that of the other discharge electrode serving as a reference discharge electrode, the exposed length of the noble-metal tip is made greater than that of the reference discharge electrode and thus the frequency of occurrence of a spark discharge on its weld metal zone can be reduced. According to the above-described embodiment, when, particularly, the weld metal zone of the ground electrode has a greater projected area than that of the weld metal zone of the center electrode, the exposed length of the noble-metal tip of the ground electrode is made greater than that of the noble-metal tip of the center electrode. This increases the distance between the weld metal zone of the ground electrode and the opposed center electrode, thereby effectively preventing the problem of concentration of an electric field induced by an edge effect which would otherwise render the weld metal zone of the ground electrode prone to spark discharge.

Figure 1B:
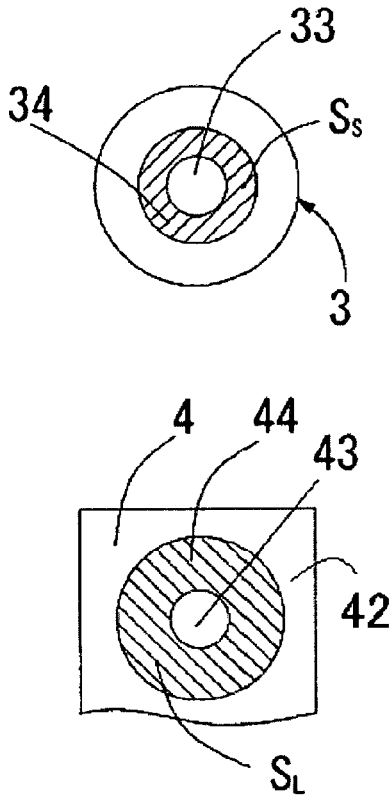
Figure 2A:
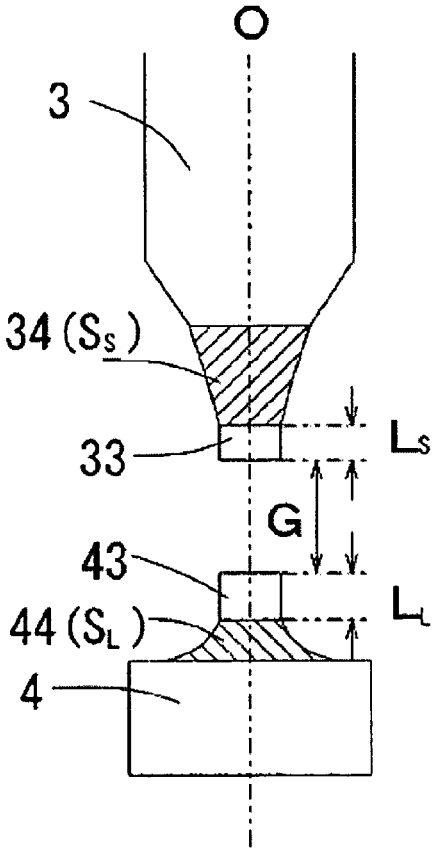
FIGS. 2(*a*) and 2(*b*) are enlarged views of the front end portion of the spark plug 100 for explaining a theory of the present invention.
Figure 2B:
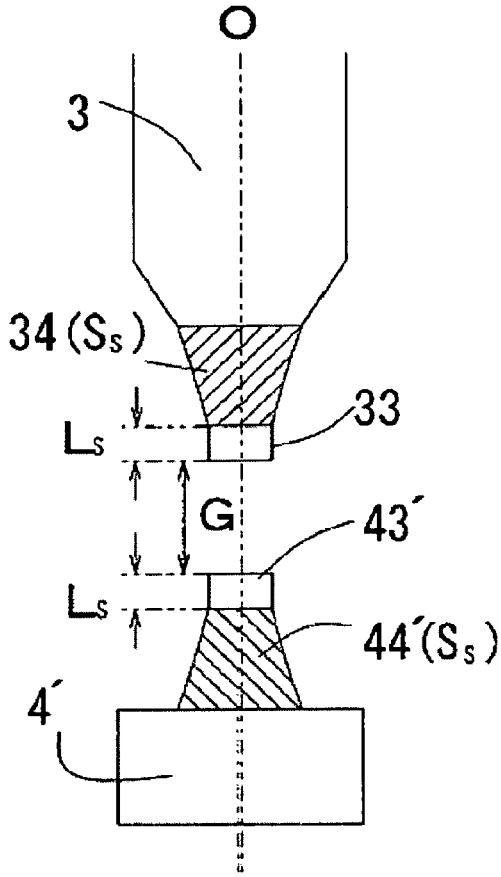
Figure 5A:
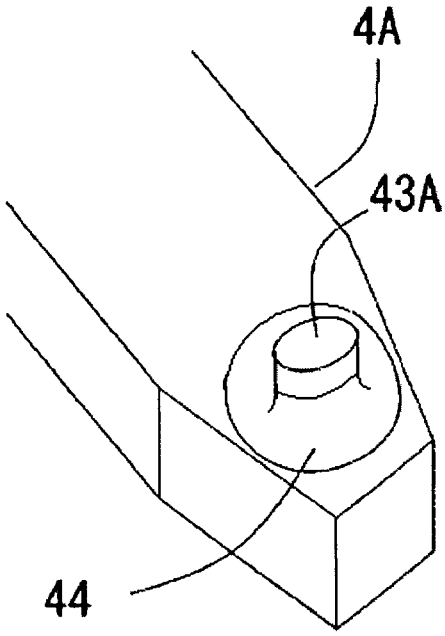
FIGS. 5(*a*) and 5(*b*) are views showing modified embodiments of the present invention.
Figure 5B:
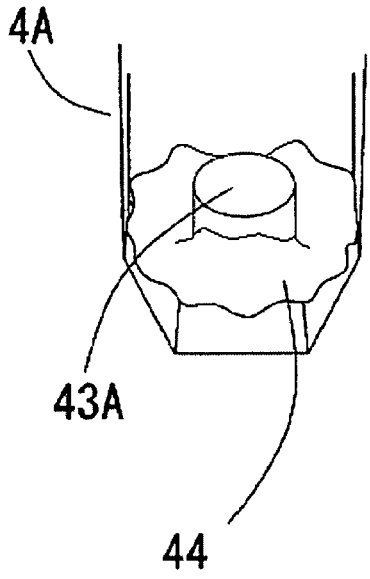

As shown in FIG. 5(*a*), a ground electrode 4A may have a tapered shape such that its width decreases toward its distal end. Alternatively, the ground electrode 4A may have a tapered shape such that its width decreases toward the center electrode. In the case where the ground electrode 4A employs such a tapered shape, welding a noble-metal tip 43A to the ground electrode 4A may cause a region melted by a laser beam, electron beam, or the like to extend up to an edge portion of the ground electrode 4A (see FIG. 5(*b*)). The present invention is effective even in such a case where an edge effect occurs. In other words, the gist of the present invention resides in the following: of the ground electrode or center electrode having a portion (denoted by E or E' in FIG. 1(*a*)) where an edge effect arises, whichever is greater in intensity of the edge effect and projected area of the weld metal zone, the exposed length of the noble-metal tip thereof is made greater than that of the other electrode. Preferably, the angle of the edge portion of the ground electrode is smaller than that of the center electrode. However, when the angle of an edge portion is difficult to measure due to rounding or the above-mentioned melting, the edge., portions of the center and ground electrodes may be compared in electric-field intensity with each other by use of a simulator or the like. Generally, an edge portion whose angle is smaller tends to exhibit a greater electric-field intensity.

The above embodiment is described in reference to a substantially annular weld metal zone. However, the shape of the weld metal zone is not limited thereto. The weld metal zone may have a so-called star shape, which stems from the trace of circumferential laser irradiation.

The axis of the noble-metal tip of the ground electrode need not necessarily coincide with the axis of the spark plug. These axes may be arranged eccentrically. However, a coaxial arrangement of the axes is preferred.

It should further be apparent to those skilled in the art that various changes in form and detail of the invention as shown and described above may be made. It is intended that such changes be included within the spirit and scope of the claims appended hereto.

This application is based on Japanese Patent Application No. 2004-285214 filed Sep. 29, 2004, incorporated herein by reference in its entirety.

What is claimed is:

1. A spark plug comprising:

a center electrode having a columnar shape;

an insulator accommodating a rear end portion of the center electrode;

a metallic shell accommodating the insulator;

a ground electrode whose first end is connected to a front end portion of the metallic shell;

a first noble-metal tip joined, via a first weld metal zone, to one of a front end portion of the center electrode and a second end portion of the ground electrode; and a second noble-metal tip joined, via a second weld metal zone, to the other of the front end portion of the center electrode and the second end portion of the ground electrode, and forming a spark discharge gap between the first and second noble-metal tips;

wherein a projected area $S_L$ of the first weld metal zone, obtained by measuring an area of the first weld metal zone projected onto an imaginary plane perpendicular to an axial direction of the first noble-metal tip, is greater than a projected area $S_S$ of the second weld metal zone, obtained by measuring an area of the second weld metal zone projected onto an imaginary plane perpendicular to an axial direction of the second noble-metal tip, and an exposed length $L_L$ of the first metal tip as measured from the first weld metal zone is greater than an exposed length $L_S$ of the second noble-metal tip as measured from the second weld metal zone.

2. The spark plug according to claim 1, wherein the first noble-metal tip is joined to the second end portion of the ground electrode, and the second noble-metal tip is joined to the front end portion of the center electrode.

3. The spark plug according to claim 1, wherein the first and second weld metal zones comprise laser welds.

4. The spark plug according to claim 1, wherein the front end portion of the center electrode is tapered such that its diameter decreases toward the axial front end of the center electrode.

5. The spark plug according to claim 2, wherein the second noble-metal tip has a diameter of 0.4 mm to 0.7 mm, and the projected area $S_S$ of the weld metal zone of the second noble-metal tip is 0.12 $mm^2$ to 0.65 $mm^2$; and the first noble-metal tip has a diameter of 0.4 mm to 0.91 mm, and the projected area $S_L$ of the weld metal zone of the first noble-metal tip is 0.44 $mm^2$ to 2.85 $mm^2$.

6. A spark plug according to claim 1, wherein the first and second noble-metal tips are formed by welding first and second noble-metal tip parts each to one of the center and ground electrodes, respectively, the first noble-metal tip part having a longer length in the axial direction than the second noble-metal tip part before welding.

* * * * *